United States Patent [19]

Ikeda et al.

[11] Patent Number: 5,072,161

[45] Date of Patent: Dec. 10, 1991

[54] DEFLECTION YOKE, A DEFLECTION DEVICE AND A MONOCHROME CRT DISPLAY

[75] Inventors: Chisato Ikeda; Yoshitaka Tomisato, both of Ueda; Yuji Kobayashi, Komoro; Naohiro Kimura, Chiisagata, all of Japan

[73] Assignee: Totoku Electric Co., Ltd., Tokyo, Japan

[21] Appl. No.: 590,906

[22] Filed: Oct. 1, 1990

[30] Foreign Application Priority Data

Oct. 6, 1989 [JP] Japan ..... 1-262651
Jun. 28, 1990 [JP] Japan ..... 2-170444

[51] Int. Cl.[5] ..... G09G 1/04; H01J 29/56; H01F 7/00

[52] U.S. Cl. ..... 315/371; 315/399; 335/210

[58] Field of Search ..... 315/371, 399; 335/210, 335/213

[56] References Cited

U.S. PATENT DOCUMENTS 4,642,528 2/1987 Kobayashi et al. ..... 335/210
4,833,432 5/1989 Ohtsu et al. ..... 335/213

*Primary Examiner*—Gregory C. Issing
*Attorney, Agent, or Firm*—Jordan and Hamburg

[57] ABSTRACT

A deflection yoke for a single beam deflection comprises a pair of horizontal deflection coils, a pair of vertical deflection coils, a correction magnet, two sets of coil pairs connected in series with the horizontal deflection coils, a bias magnet and an auxiliary coil magnetically coupled to the coil pairs and supplied a vertical deflection current. A deflection device comprises the deflection yoke, a horizontal deflection circuit and a vertical deflection circuit. A monochrome CRT display comprises the deflection device, an video processing device and a monochrome CRT.

6 Claims, 5 Drawing Sheets

200

DEFLECTION YOKE, A DEFLECTION DEVICE AND A MONOCHROME CRT DISPLAY

BACKGROUND OF THE INVENTION

1. Field of the Invention

This invention relates to a deflection yoke, a deflection device, and a monochrome CRT display, and more particularly to a deflection yoke and a deflection device useful for single beam deflection in a large monochrome CRT display, or a high resolution FST scanner, etc., and a monochrome CRT display using such a deflection device.

2. Description of the Prior Art

In CRTs, since the beam arrival distance at the central portion of the screen and that at the peripheral portion thereof are different from each other, even if an adjustment is made at the central portion of the screen so that the most satisfactory focus is provided, the focus may become unsatisfactory at the periphery of the screen (deflection defocus). Further, a picture to be originally displayed as a rectangle may be displayed as a distorted one (deflection distortion).

For this reason, in monochrome CRT displays such as display monitors or television receivers, etc., using a conventional monochrome CRT, the winding distribution of a deflection coil is adjusted, or a correction magnet is arranged at a suitable position. Further, in order to improve the deflection defocus, a dynamic focus to modulate a focus voltage in a parabolic manner in correspondence with the scanning of beam is carried out.

On the other hand, in display monitors or television receivers using a color CRT, there is known a technology to vary the horizontal deflection magnetic field distribution in synchronism with the vertical deflection to thereby make a correction of convergence (Japanese Utility Model Application No. 139304/1984).

In recent years, it has been increasingly demanded that monochrome CRT displays have enlarged screens, increased deflection angles, flatness, and high resolution. To meet these demands, still improvements in the deflection defocus and the deflection distortion are necessary.

However, with the conventional technologies to adjust a winding distribution of a deflection coil, to provide a correction magnet, and to modulate a focus voltage, there is the problem that a sufficient improved effect cannot be provided under the condition of an enlarged screen more than 15 inches, an increased deflection angle more than 90 degrees, a high flatness factor more than curvature of 1 m, and a high resolution more than 1000 lines or 4 lines/mm.

On the other hand, as stated above, in the color CRT displays, there is known the conventional technology to vary the horizontal deflection magnetic field distribution in synchronism with the vertical deflection to make a correction of convergence. However, in the monochrome CRT display where the concept of convergence itself does not exist, application of such a conventional technology is not conceived at all as a matter of course.

SUMMARY OF THE INVENTION

With such circumstances in view, the inventors of this invention have energetically made studies. As a result, they have found that a scheme is employed to adjust the winding distribution of a deflection coil and provide a correction magnet, and further to vary the horizontal deflection magnetic field distribution in synchronism with the vertical deflection, thereby making it possible to improve to great extent the deflection defocus and the deflection distortion in the monochrome CRT display.

Accordingly, an object of this invention is to provide a deflection yoke and a deflection device capable of sufficiently improving a deflection defocus and a deflection distortion even under the condition of an enlarged screen more than 15 inches, an increased deflection angle more than 90 degrees, a high flatness factor more than curvature of 1 m, and a high resolution more than 1000 lines or 4 lines/mm, and a monochrome CRT display using such a deflection device.

In accordance with the first aspect, this invention provides a deflection yoke for a single beam deflection including a pair of horizontal deflection coils on the upper and lower sides, a pair of vertical deflection coils, and a correction magnet, characterized in that two sets of coil pairs are provided, each coil pair being formed by connecting in series and two coils in each coil pairs wound on a magnetic core so that their magnetic directions are opposite to each other, the two coils being adapted so that a magnetic bias is given thereto by a bias magnet; that there is provided an auxiliary coil magnetically coupled to these coil pairs; that the coil pairs are connected in series with the horizontal deflection coils on the upper and lower sides, respectively; that there are provided horizontal deflection current supply terminals for supplying horizontal deflection currents to the horizontal deflection coils and the coil pairs; that the auxiliary coil is connected in series with the pair of vertical deflection coils, respectively; and that there are provided vertical deflection current supply terminals for supplying a vertical deflection current to the vertical deflection coils and the auxiliary coil.

In accordance with the second aspect, this invention provides a deflection yoke for a single beam deflection including a pair of horizontal deflection coils on the upper and lower sides, a pair of vertical deflection coils, and a correction magnet, characterized in that two sets of coil pairs are provided, each coil pair being formed by connecting in series and two coils in each coil pair wound on a magnetic core so that their magnetic directions are opposite to each other, the two coils being adapted so that a magnetic bias is given thereto by a bias magnet; that there provided an auxiliary coil magnetically coupled to these coil pairs; that the coil pairs are connected in series with the horizontal deflection coils on the upper and lower sides, respectively; that there are provided horizontal deflection current supply terminals for supplying horizontal deflection currents to the horizontal deflection coils and the coil pairs; that there are provided vertical deflection current supply terminals for supplying a vertical deflection current to the vertical deflection coils; and that there are provided vertical correction current supply terminals for supplying a vertical correction current to the auxiliary coil.

In accordance with the third aspect, this invention provides a deflection device comprising a deflection yoke for a single beam deflection including a pair of horizontal deflection coils on the upper and lower sides, a pair of vertical deflection coils, and a correction magnet; a coil unit including two sets of coil pairs, each coil pair being formed by connecting in series and two coils in each coil pair wound on a magnetic core so that their magnetic directions are opposite to each other, the two coils being adapted so that a magnetic bias is given by a bias magnet, and an auxiliary coil magnetically coupled to these coil pairs; a horizontal deflection circuit for supplying horizontal deflection currents to the horizontal deflection coils on the upper and lower sides and the coil pairs of the coil unit; and a vertical deflection circuit for supplying a vertical deflection current to the pair of vertical deflection coils and the auxiliary coil of the coil unit.

In accordance with the fourth aspect, this invention provides a deflection device comprising a deflection yoke for a single beam deflection including a pair of horizontal deflection coils on the upper and lower sides, a pair of vertical deflection coils, and a correction magnet; a coil unit including two sets of coil pairs, each coil pair being formed by connecting in series and two coils in each coil pair wound on a magnetic core so that their magnetic directions are opposite to each other, each coil pair being adapted so that a magnetic bias is given thereto by a bias magnet, and an auxiliary coil magnetically coupled to these coil pairs, a horizontal deflection circuit for supplying horizontal deflection currents to the horizontal deflection coils on the upper and lower sides and the coil pairs of the coil unit; a vertical deflection unit for supplying a vertical deflection current to the pair of vertical deflection coils; and a vertical correction circuit for delivering a vertical correction current synchronous with the vertical deflection current to the auxiliary coil of the coil unit.

In accordance with the fifth aspect, this invention provides a monochrome CRT display comprising the deflection device based on the above third aspect or the deflection device based on the above fourth aspect, an video processing device, and a monochrome CRT.

In the deflection yoke based on the first aspect and the deflection device based on the third aspect of this invention, a vertical deflection current is caused to flow in the auxiliary coil to produce a magnetic flux synchronous with the vertical deflection from the auxiliary coil to differentially vary the impedance values of the coil pairs by the magnetic flux, to thereby differentially vary horizontal deflection currents flowing in the horizontal deflection coils on the upper and lower sides. Thus, the horizontal deflection magnetic field distribution is differentially changed in synchronism with the vertical deflection.

By an adjustment of the winding distribution of the deflection coils, provision of the correction magnet, and formation of a horizontal deflection magnetic field distribution differentially varying at the vertical deflection period, deflection defocus and deflection distortion in a single beam deflection can be improved to a great degree.

In the deflection yoke based on the second aspect and the deflection device based on the fourth aspect of this invention, the same constructions as those of the deflection yoke based on the first aspect and the deflection device based on the third aspect are adopted except that a vertical correction current synchronous with the vertical deflection current flows in the auxiliary coil.

Accordingly, the same operation and effects as stated above are provided. While the deflection yoke based on the second aspect and the deflection device based on the fourth aspect are more complicated in structure than the deflection yoke based on the first aspect and the deflection device based on the third aspect, they are more advantageous in the crosstalk in the vertical deflection and the horizontal deflection, and the degree of freedom of correction.

In the monochrome CRT display based on the fifth aspect, since the above-mentioned deflection device is employed, deflection defocus and deflection distortion are suppressed. Thus, a sufficient picture quality can be provided even under the condition of an enlarged screen more than 15 inches, an increased deflection angle more than 90 degrees, a high flatness factor more than curvature of 1 m, and a high resolution more than 1000 lines or 4 lines/mm.

DESCRIPTION OF THE PREFERRED EMBODIMENTS

This invention will now be described in more detail in accordance with the embodiments shown in drawings. It is to be noted that this invention is not limited by such embodiments.

Figure 2:
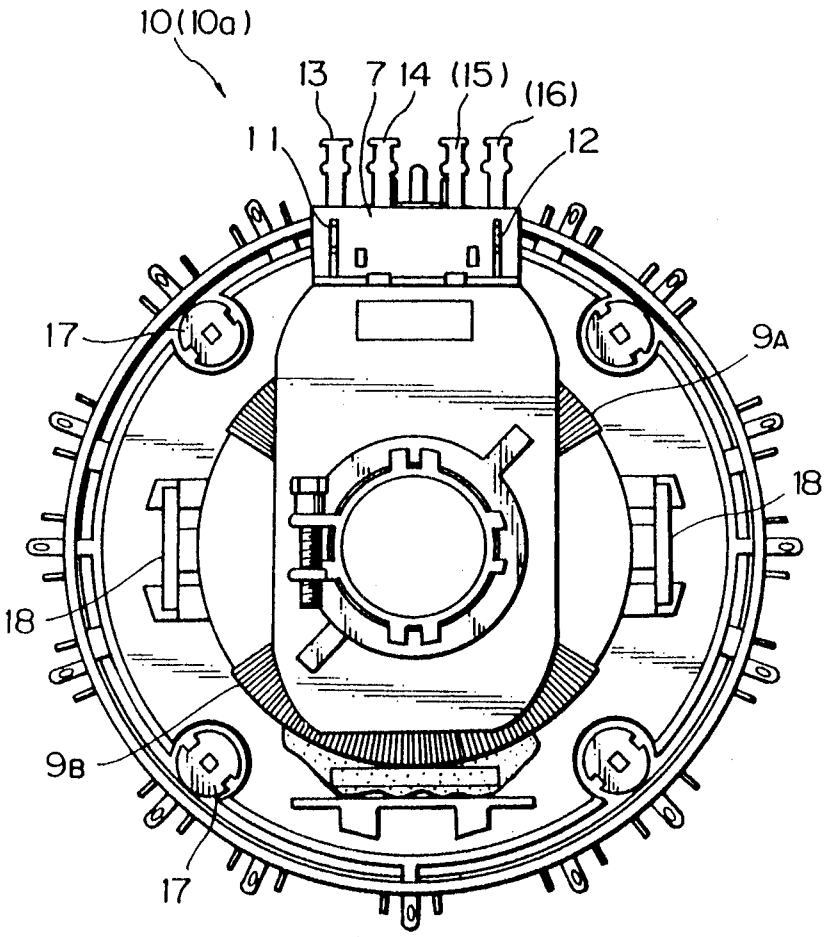
FIG. 2 is a back view of the deflection yoke shown in FIG. 1.
Figure 1:
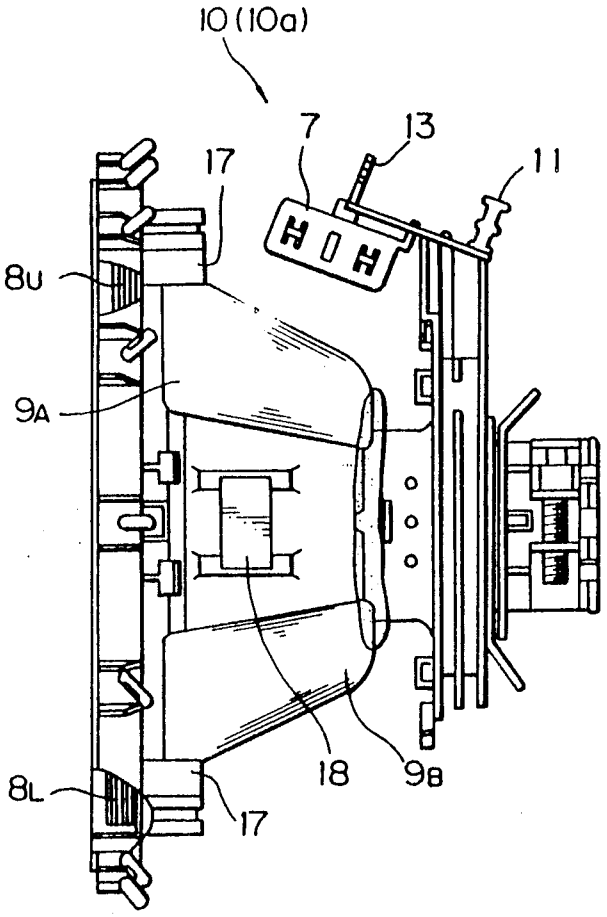
FIG. 1 is a side view of a deflection yoke of an embodiment according to this invention.

FIG. 1 is a side view showing a deflection yoke 10 of an embodiment according to this invention, and FIG. 2 is a back view of the above-mentioned deflection yoke 10.

This deflection yoke 10 includes a horizontal deflection coil 8U on the upper side, a horizontal deflection coil 8L on the lower side, a pair of vertical deflection coils 9A and 9B, a correction rotary magnet 17, and a correction rod-shaped magnet 18. The deflection yoke 10 further includes a coil unit 7, horizontal deflection current supply terminals 11 and 12, and vertical deflection current supply terminals 13 and 14.

Figure 3:
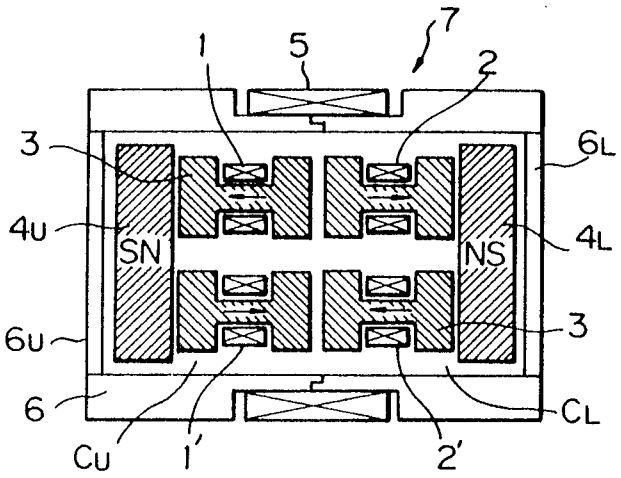
FIG. 3 is a cross sectional view showing the configuration of a coil unit.

FIG. 3 is a cross sectional view showing the configuration of the above-mentioned coil unit 7.

Respective coils 1, 1' and 2, 2' are wound onto drum-shaped ferrite cores 3 serving as magnetic cores, respectively.

The coils 1 and 1' are connected in series so that their magnetic directions are opposite to each other, and are adapted so that a magnetic bias is given thereto by a bias magnet 4U. Thus, these coils 1 and 1' constitute a coil pair CU.

In addition, coils 2 and 2' are connected in series so that their magnetic directions are opposite to each other, and are adapted so that a magnetic bias is given thereto by a bias magnet 4L. Thus, these coils 2 and 2' constitute a coil pair CL.

As understood from FIG. 3, the coil pair CU and the coil pair CL are magnetically mirror-symmetric.

Two sets of the coil pairs CU and CL are accommodated within an insulating case 6.

An auxiliary coil 5 is wound onto the outer peripheral surface of the insulating case 6 so that it is magnetically coupled with the above-mentioned coils 1, 1' and 2, 2'.

Generally, unevenness in manufacturing process cannot be avoided in connection with the coils 1, 1' and 2, 2', and the drum-shaped ferrite cores 3. Therefore, it is necessary to adjust, at the time of assembling, the characteristics of the coil pairs CU and CL constituted by the above-mentioned members in correspondence with the characteristics of the horizontal deflection coils 8U and 8L. However, since it is difficult to exchange the coils 1, 1' and 2, 2' and the drum-shaped ferrite cores 3, a procedure is taken to prepare five to ten kinds of bias magnets 4U and 4L to make an adjustment by exchanging any one of them according to need. For this reason, an arrangement is employed to detach the cover 6U or 6L of the insulating case 6, thus permitting exchange of the bias magnet 4U or 4L. In this instance, since the bias magnets 4U and 4L for respective coil pairs CU and CL are magnetically independent, it is possible to completely independently make an adjustment for allowing the characteristic of the coil pair CU to be in correspondence with that of the horizontal deflection coil 8U on the upper side and an adjustment for allowing the characteristic of the coil pair CL to be in correspondence with that of the horizontal deflection coil 8L on the lower side. Thus, adjustment extremely becomes easy, resulting in an improved productivity of the assembling line.

Figure 4:
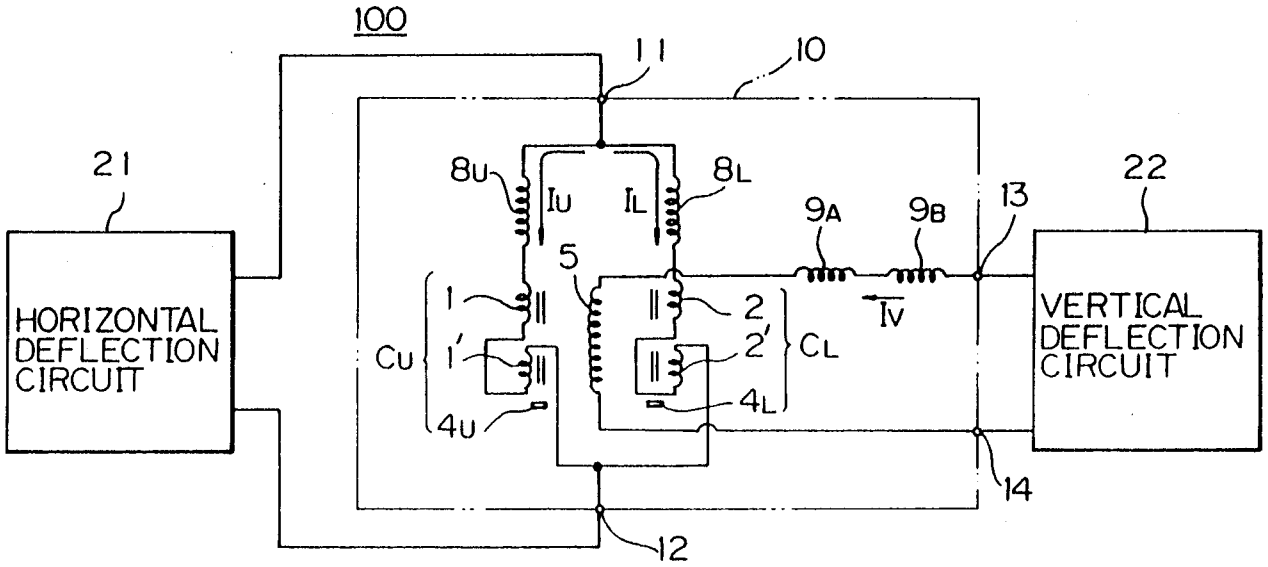
FIG. 4 is a block diagram of a deflectin device of an embodiment according to this invention.

FIG. 4 is a block diagram showing a deflection device 100 constituted by the above-mentioned deflection yoke 10, a horizontal deflection circuit 21, and a vertical deflection circuit 22.

Within the deflection yoke 10, the upper side horizontal deflection coil 8U and the coils 1, 1' of the coil unit 7 are connected in series, and the lower side horizontal deflection coil 8L and the coils 2, 2' of the coil unit 7 are connected in series. Moreover, horizontal deflection currents IU and IL are supplyed from the horizontal deflection circuit 21 through horizontal deflection current supply terminals 11 and 12 to the above-mentioned coils 1, 1' and 2, 2', respectively Further, within the deflection yoke 10, a pair of vertical deflection coils 9A and 9B, and the auxiliary coil 5 of the coil unit 7 are connected in series. To these coils, a vertical deflection current IV is supplied from the vertical deflection circuit 22 through the vertical deflection current supply terminal 13 and 14.

Figure 5:
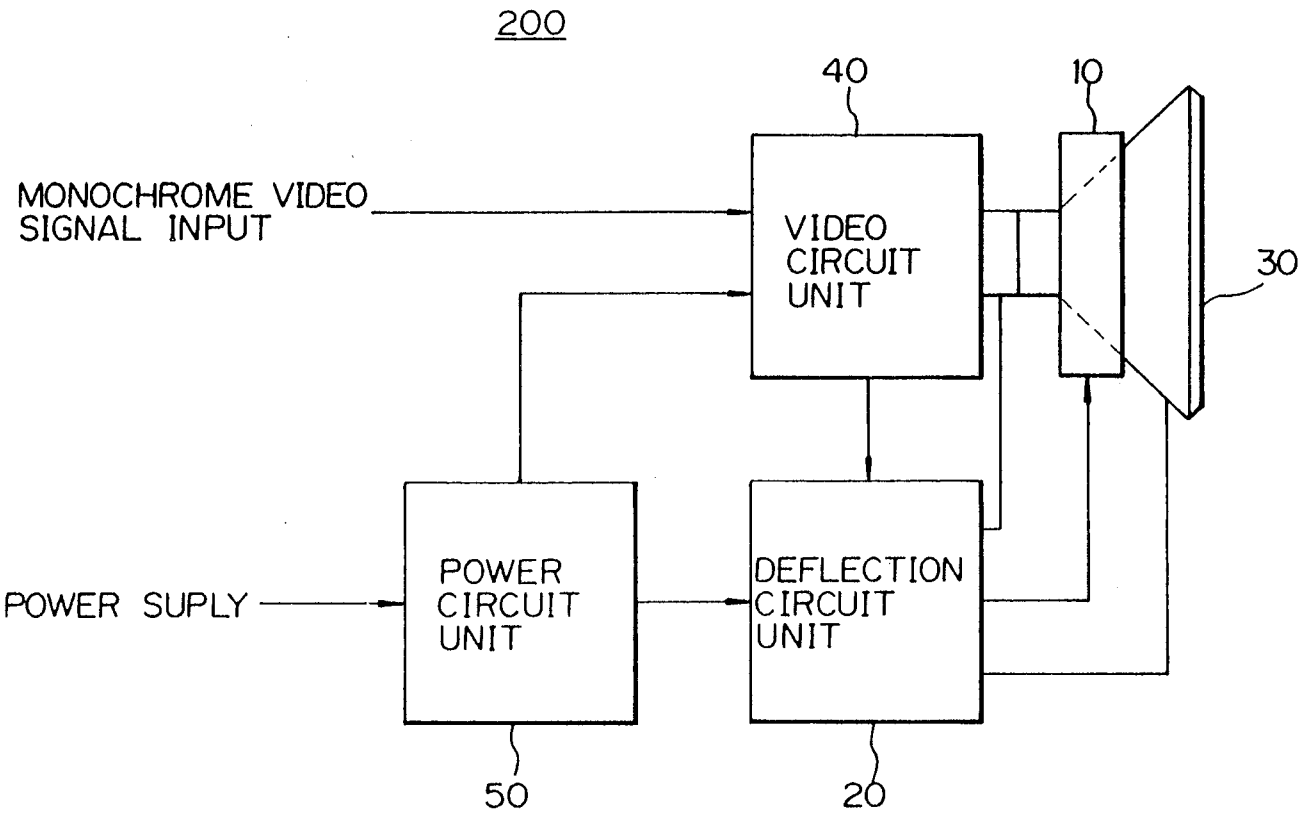
FIG. 5 is a block diagram of a monochrome CRT display of an embodiment according to this invention.

FIG. 5 is a block diagram showing a monochrome CRT display 200 including the above-mentioned deflection device 100.

This monochrome CRT display 200 comprises a deflection circuit unit 20 for driving the above-mentioned deflection yoke 10, a monochrome CRT 30 to which the above-mentioned deflection yoke 10 is affixed, an video circuit unit 40, and a power circuit unit 50. The horizontal deflection circuit 21 and the vertical deflection circuit 22 both mentioned above are included in the deflection circuit unit 20.

The operation of the above-described embodiment will now be described.

Figure 6:
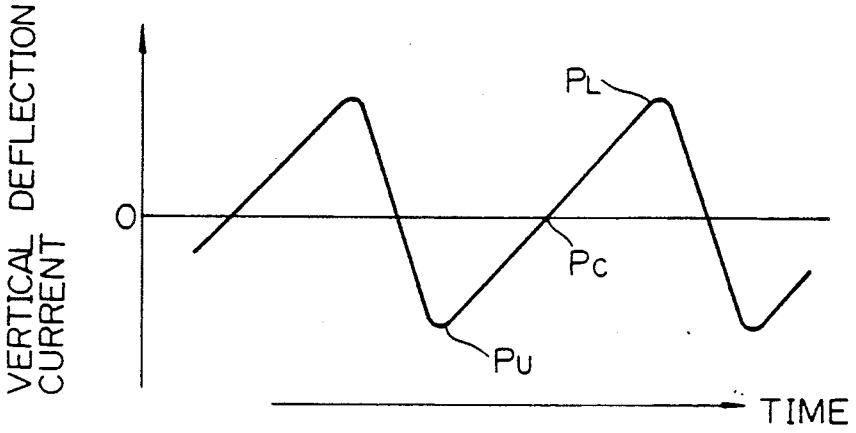
FIG. 6 is a waveform diagram of a vertical deflection current.
Figure 7:
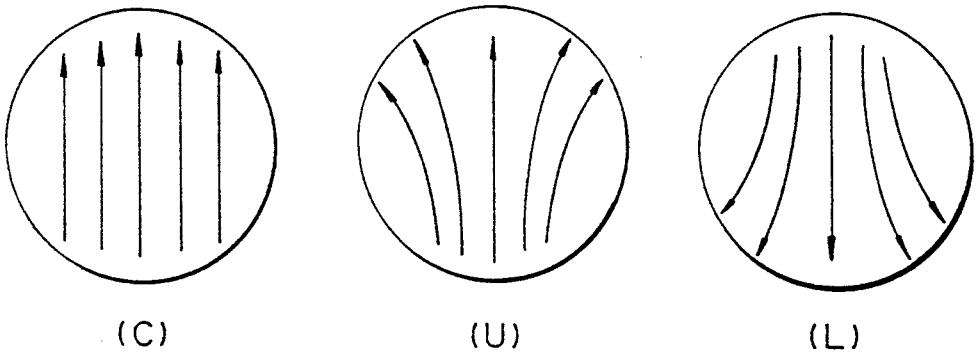
FIGS. 7(C), (U) and (L) are explanatory diagram showing a horizontal deflection magnetic field distribution.

In the case where a vertical deflection current IV flows as shown in FIG. 6, at the time point Pc when the beam scans the intermediate portion of the screen, the vertical deflection current IV is equal to zero. At this time, the auxiliary coil 5 of the coil unit 7 does not produce a magnetic flux. As a result, the impedance of the coil pair CU and that of the coil pair CL are equal to each other. Thus, a current IU flowing in the upper side horizontal deflection coil 8U and a current IL flowing in the lower side horizontal deflection coil 8L are equal to each other. As a result, the horizontal deflection magnetic field distribution presents a homogeneous magnetic field as shown in FIG. 7(C). Namely, this case does not exert a special effect on the beam.

However, at the time point PU when the beam scans the upper portion of the screen, the auxiliary coil 5 produces a magnetic flux to allow the impedance of the coil pair CU to be large, and to allow the impedance of the coil pair CL to be small. Namely, by the magnetic flux produced from the auxiliary coil 5, there occurs a differential change such that the coil pair CU is placed in a state close to an unsaturated state and the coil pair CL is placed in a state close to a saturated state, thus to allow the impedance of the coil pair CU to be large and to allow the impedance of the coil pair CL to be small. For this reason, a current IU flowing in the horizontal deflection coil 8U becomes small, and a current IL flowing in the horizontal deflection coil 8L becomes large. As a result, a horizontal deflection magnetic field as shown in FIG. 7(U) is provided. Namely, the upper portion of the screen where the beam passes is placed in the state of a pin cushion magnetic field. This pin cushion magnetic field provides an effect for improving the deflection defocus and the deflection distortion.

At the time point PL when the beam scans the lower portion of the screen, the auxiliary coil 5 produces a magnetic flux 5, thus to allow the impedance of the coil pair CU to be small and to allow the impedance of the coil pair CL to be large. Namely, by the magnetic flux produced from the auxiliary coil 5, there occurs a differential change such that the coil pair CU is placed in a state close to a saturated state and the coil pair CL is placed in a state close to an unsaturated state, thus to allow the impedance of the coil pair CU to be small and to allow the impedance of the coil pair CL to be large. For this reason, a current IU flowing in the horizontal deflection coil 8U becomes large, and a current IL flowing in the horizontal deflection coil 8L becomes small. As a result, a horizontal deflection magnetic field distribution as shown in FIG. 7(L) is provided. Namely, the lower portion of the screen where the beam passes is placed in the state of a pin cushion magenetic field. This pin cushion magnetic field provides an effect for improving the deflection defocus and the deflection distortion.

Figure 8:
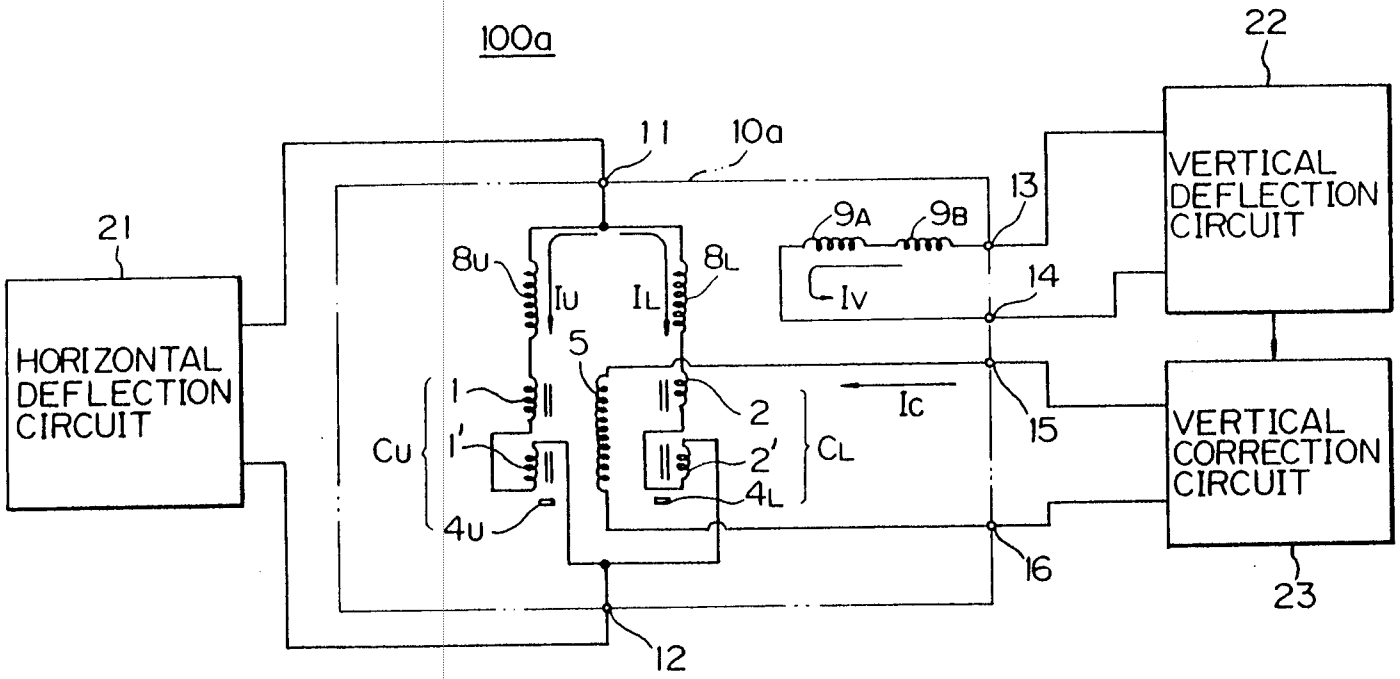
FIG. 8 is a block diagram of a deflection device of another embodiment according to this invention.

FIG. 8 is a block diagram showing a deflection device **100*a*** of another embodiment according to this invention.

A deflection yoke **10*a* in this deflection device 100*a* comprises vertical correction current supply terminals 15 and 16 parenthesized in FIG. 1, and the auxiliary coil 5 of the coil unit 7 is connected to the vertical correction current supply terminals 15 and 16. The vertical deflection coils 9A and 9B are connected to the vertical deflection current supply terminals 13 and 14**.

The vertical correction circuit 23 delivers a vertical correction current IC proportional to (e.g., two times larger than) the vertical deflection current IV to the auxiliary coil 5 through the vertical correctin current supply terminals 15 and 16. Thus, the advantages similar to the above is provided.

Since the above-mentioned deflection device **100*a* permits a vertical correction current free from restriction as in the vertical deflection current to flow in the auxiliary coil 5, this device is more advantageous than the above-described deflection device 100 particularly in the degree of freedom although its construction is more complicated than that of the above-described deflection device 100**.

As a further embodiment of this invention, an arrangement may be employed such that the coil unit 7 is provided, e.g., on the deflection circuit unit 20 in place of providing it on the deflection yoke 10 or 10*a*.

In accordance with this invention, the deflection defocus or the deflection distortion in the single beam deflection can be improved to a great extent. Thus, a monochrome CRT display having a sufficient picture quality can be provided even under the condition of an enlarged screen more than 15 inches, an increased deflection angle more than 90 degrees, a high flatness factor more than curvature of 1 m, and a high resolution more than 1000 lines or 4 lines/mm.

What is claimed is:

1. A monochrome deflection yoke for a single beam deflection including upper and lower horizontal deflection coils, a pair of vertical deflection coils, and a correction magnet, said deflection coils being arranged to provide a substantially homogeneous magnetic field, said deflection yoke comprising first and second pairs of coils, the two coils of each coil pair being connected in series, the two coils in each coil pair being wound on a magnet core with their magnetic directions opposite to one another, said yoke further comprising a bias magnet arrangement mounted to apply a magnetic bias to said two coils of each pair; an auxiliary coil magnetically coupled to the coils of both of said coil pairs; said coils of said first and second coil pairs being connected in series with said upper and lower horizontal deflection coils, respectively; horizontal deflection current supply terminals connected to supply horizontal deflection currents to said horizontal deflection coils and the coils of said coil pairs; said auxiliary coil being connected in series with said vertical deflection coils; and vertical deflection current supply terminals connected to supply a vertical deflection current to said vertical deflection coils and said auxiliary coil.

2. A monochrome deflection yoke for a single beam deflection including upper and lower horizontal deflection coils, a pair of vertical deflection coils, and a correction magnet, said deflection coils being arranged to provide a substantially homogeneous magnetic field, said deflection yoke comprising first and second coil pairs, the two coils of each coil pair being connected in series, the two coils in each coil pair being wound on a magnetic core with their magnetic directions opposite to one another, said yoke further comprising a bias magnet arrangement mounted to apply a magnetic bias to said two coils of each pair; an auxiliary coil magnetically coupled to the coils of both of said coil pairs; said coils of said first and second coil pairs being connected in series with said upper and lower horizontal deflection coils, respectively; horizontal deflection current supply terminals connected to supply horizontal deflection currents to said horizontal deflection coils and the coils of said coil pairs; vertical deflection current supply terminals connected to supply a vertical deflection current to said vertical deflection coils; and vertical correction current supply terminals connected to supply a vertical correction current to said auxiliary coil.

3. A monochrome deflection device comprising:

a deflection yoke for a single beam deflection including upper and lower horizontal deflection coils, a pair of vertical deflection coils, and a correction magnet, said deflection coils being arranged to provide a substantially homogeneous magnetic field;

a coil unit including first and second pairs of coils, the two coils of each coil pair being connected in series, the two coils in each coil pair being wound on a magnetic core with their magnetic directions opposite to one another, said yoke further comprising a bias magnet arrangement mounted to apply a magnetic bias to said two coils of each pair, and an auxiliary coil magnetically coupled to the coils of both of said coil pairs;

a horizontal deflection circuit connected to supply horizontal deflection currents to said upper and lower horizontal deflection coils and said coil pairs of said coil unit; and a vertical deflection circuit connected to supply a vertical deflection current to the coils of said pair of vertical deflection coils and to said auxiliary coil of said coil unit.

4. A monochrome deflection device comprising:

a deflection yoke for a single beam deflection including a upper and lower horizontal deflection coils, a pair of vertical deflection coils, and a correction magnet, said deflection coils being arranged to provide a substantially homogeneous magnetic field;

a coil unit including first and second pairs of coils, the coils of each coil pair being connected in series, the two coils in each coil pair being wound on a magnetic core with their magnetic directions opposite to one another, said yoke further comprising a bias magnet arrangement mounted to apply a magnetic bias to said two coils of each coil pair, and an auxiliary coil magnetically coupled to the coils of both of said coil pairs, a horizontal deflection circuit connected to apply horizontal deflection currents to said upper and lower horizontal deflection coils and to said coil pairs of said coil units;

a vertical deflection circuit connected to apply a vertical deflection current to the coils of said pair of vertical deflection coils; and a vertical correction circuit connected to apply a vertical correction current synchronous with said vertical deflection current to said auxiliary coil of the coil unit.

5. A monochrome CRT display comprising said deflection device as set forth in claim 3, a video processing device, and a monochrome CRT.

6. A monochrome CRT display comprising said deflection device as set forth in claim 4, a video processing device, and a monochrome CRT.

* * * * *